United States Patent [19]

Boorman, Jr.

[11] 4,244,637

[45] Jan. 13, 1981

[54] TRACK ASSEMBLY

[75] Inventor: Earl D. Boorman, Jr., Louisville, Ky.

[73] Assignee: General Electric Company, Louisville, Ky.

[21] Appl. No.: 33,356

[22] Filed: Apr. 26, 1979

[51] Int. Cl.[3] ..... A47B 96/12

[52] U.S. Cl. ..... 312/350; 312/351; 248/243; 411/535

[58] Field of Search ..... 312/350, 351, 339, 270, 312/239; 248/188.2, 243; 52/122, 126, 717, 718; 85/50 R, 50 A; 308/244; 108/108, 109

[56] References Cited

U.S. PATENT DOCUMENTS

| | | | |
|---|---|---|---|
| 1,393,012 | 10/1921 | Dilg . | |
| 1,450,625 | 4/1923 | Alexander | 85/50 A |
| 2,281,769 | 5/1942 | Hochriem . | |
| 2,473,307 | 6/1949 | Seipt et al. | 308/244 |
| 2,860,942 | 11/1958 | Carew . | |
| 3,110,536 | 11/1963 | Costantini et al. | 312/350 |
| 3,397,934 | 8/1968 | Dushek . | |
| 3,854,686 | 12/1974 | Konstant . | |
| 4,043,625 | 8/1977 | Bleeker | 312/350 |
| 4,076,202 | 2/1978 | McConnell . | |

*Primary Examiner*—Casmir A. Nunberg
*Attorney, Agent, or Firm*—Frederick P. Weidner; Radford M. Reams

[57] ABSTRACT

A track assembly for securing to a wall and receiving shelves. The track assembly includes an elongated strip which is U-shaped in lateral cross section to provide two spaced parallel legs in a connecting portion. Supports are attached to the strip for receiving shelves thereon. There is also provided a shim having a base with a top and bottom surface, the bottom surface contacts the wall and each of two parallel sides of the shim has a step, said steps being spaced apart a distance equal to the distance of the spaced parallel legs of the strip and the other two parallel sides of the shim being unstepped and spaced apart from each other a distance greater than the distance of the spaced parallel legs of the strip.

14 Claims, 4 Drawing Figures

TRACK ASSEMBLY

BACKGROUND OF THE INVENTION

The present invention relates to a track assembly and more particularly to a cantilever track assembly for use in refrigerators.

The fresh food storage compartment of a refrigerator normally includes a number of vertically shaped shelves which are supported on elongated strips by means of support arms that are adjustably secured to those strips. Normally, these strips are secured by screws to the rear refrigerator cabinet liner. One of the difficulties in such an assembly is that the rear liners are or may be bowed or deformed. Because of this, the strips are out of vertical alignment and the support arms attached to them for supporting the shelves are out of alignment with respect to each other. This mis-alignment can cause problems of fit and appearance of the shelves.

In many cases, it is desirable to have two shelves positioned on the support arms in the same plane and these shelves have side edge portions that are parallel. This is where the track assembly includes three strips and the middle strip is secured to a section of the liner that is bowed. When placing the shelves on the support arms, it is important that the strips holding the support arms be in vertical alignment as otherwise the shelves cannot be placed at the same level as they interfere with each other.

By the present invention, there is provided a track assembly that compensates for the above-mentioned difficulties and provides a low cost means of adjusting strips that support shelves that are to be secured to walls that are bowed or deformed, such as refrigerator liners.

SUMMARY OF THE INVENTION

In accordance with the present invention, there is provided a track assembly for securing to a wall and receiving shelves. The track assembly includes an elongated strip which is U-shaped in lateral cross section to provide two-spaced parallel legs and a connecting portion. There are support means attached to the strip for supporting shelves thereon. There is also provided a shim having a base with a top and bottom surface, the bottom surface contacts the wall and each of two parallel sides of the shim has a step, said steps being spaced apart a distance equal to the distance of the spaced parallel legs of the strip and the other two parallel sides of the shim being unstepped and spaced apart from each other a distance greater than the distance of the spaced parallel legs of the strip.

DESCRIPTION OF THE PREFERRED EMBODIMENT

Figure 1:
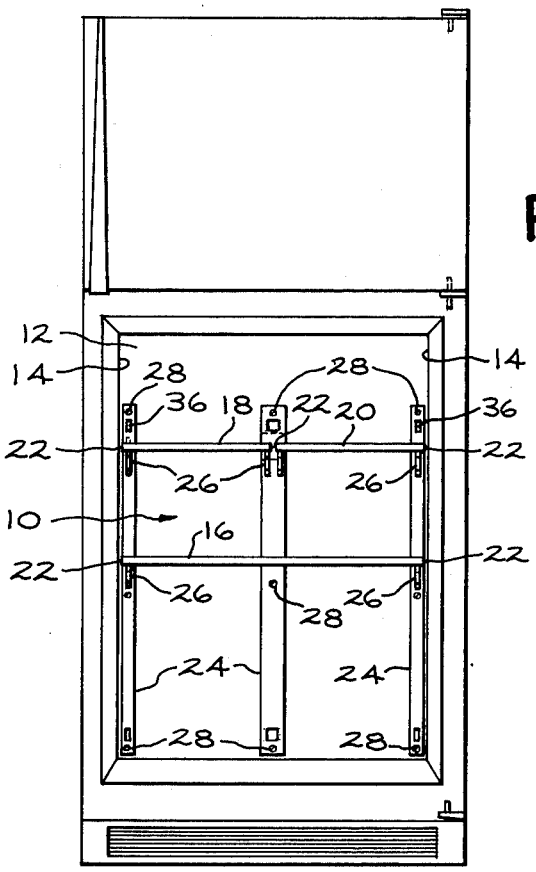
FIG. 1 is a front elevational view of a household refrigerator showing the track assembly of the present invention.
Figure 2:
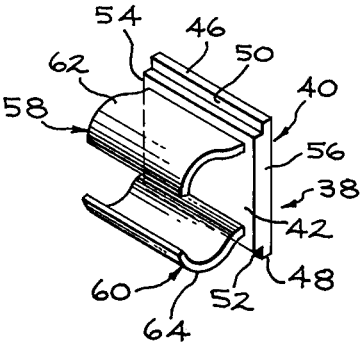
FIG. 2 is a perspective view of the shim of the track assembly.

Referring to FIG. 1, there is shown a refrigerator cabinet, including a storage compartment 10, defined by a rear wall 12 and spaced side walls 14; the compartment having an access at the front thereof closed by a door, not shown.

The compartment 10 contains a plurality of vertically spaced storage shelves, such as shelf 16, and also two side-by-side shelves, 18 and 20, supported in the same plane. These shelves, including the two side-by-side shelves, occupy substantially the entire horizontal cross sectional area of the compartment. These shelves 16, 18 and 20 are of a generally rectangular configuration, including parallel side portions 22.

It is desirable that the shelves of a refrigerator be vertically adjustable in order to provide spacing of the shelves as desired by the user. In order to provide means by which the user may quickly select the desired vertical position of the shelves, there is, as shown in FIG. 1, the track assembly of the present invention. The track assembly includes three spaced, parallel, elongated, rigid strips 24 secured to the rear wall 12 which, in the case of one embodiment, is the interior liner of the refrigerator. The track assembly also includes shelf support means such as brackets 26. The strips 24 are made of rigid material to withstand the weight of the shelves and their contents and are attached to the rear wall 12 by any suitable means such as headed attachment elements or screws 28.

Figure 3:
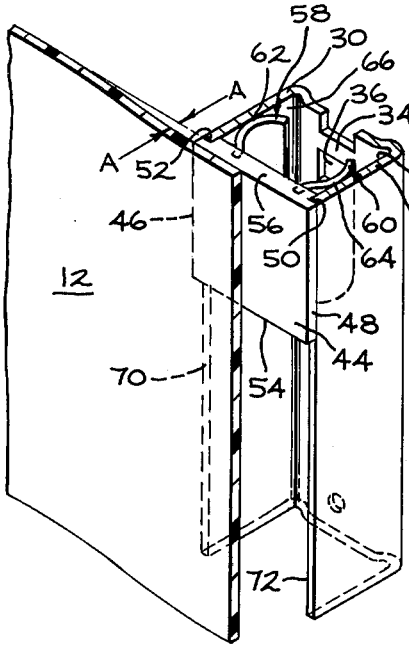
FIG. 3 is a perspective view of the track assembly of the present invention showing the shim in one position.
Figure 4:
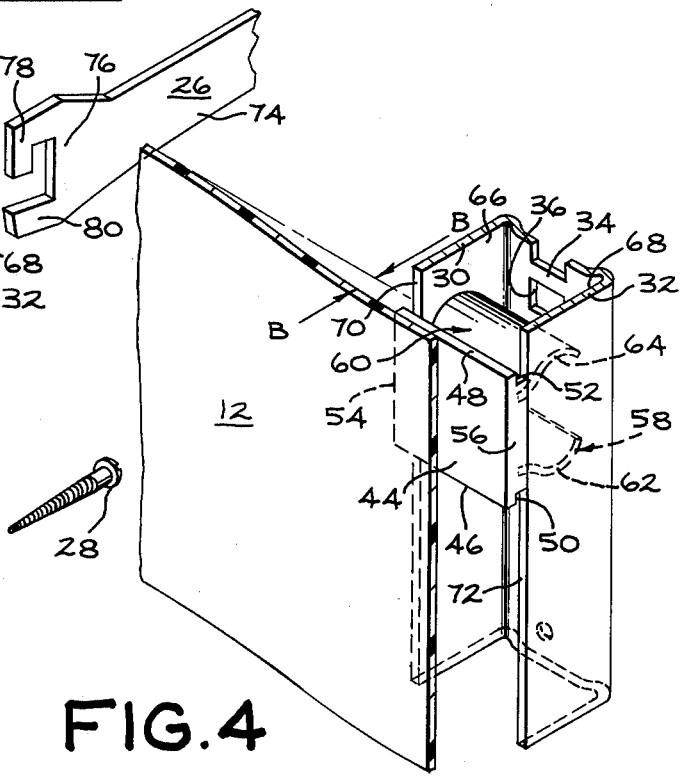
FIG. 4 is a perspective view of the track assembly of the present invention showing the shim in a second position.

As shown in FIGS. 3 and 4, the elongated strips 24 are U-shaped, as viewed in lateral cross section and includes two legs 30 and 32 and a connecting middle portion 34 with the free terminal ends 70 and 72 of the legs 30 and 32 abutting the rear wall 12 of the cabinet liner. The connecting middle portion 34 has a plurality of rectangular slots 36 that run along the length of each strip 24. In the case of the middle strip, there is a wide row of slots along its length. Alternatively, there could be provided two parallel rows of slots along its length. This allows the two side-by-side shelves 18 and 20 to be moved up or down relative to each other, if desired by the user. This is particularly important since the top shelf is usually to provide for the storage of milk bottles, beverage bottles and similar, rather relatively tall items.

The track assembly also includes a shim 38 having a base 40 with a top surface 42, and a bottom surface 44. The bottom surface 44 of the shim is in contact with the rear wall 12 of the cabinet liner. Each of two parallel sides 46 and 48, respectively, has a step 50 and 52, respectively. These steps are parallel to each other and extend the entire length of the sides 46 and 48. The other two parallel sides 54 and 56 of the base 40 are unstepped along their lengths. The steps 50 and 52 are spaced apart a distance equal to the distance between the terminal ends 70 and 72 of the spaced parallel legs 30 and 32 of the strip 24. The two unstepped parallel sides 54 and 56 are spaced apart from each other a distance greater than the distance between the terminal ends 70 and 72 of the spaced parallel legs 30 and 32 of the strip 24.

The top surface 42 of the base 40 of shim 38 has projecting outwardly therefrom means for securing the shim 38 to the strip 24. In the embodiment shown, the securing means are a pair of spaced, bowed, deflectable members 58 and 60. The distance between the bowed areas 62 and 64 of the securing members 58 and 60, respectively, is slightly greater than the inside distance between the legs 30 and 32 of the strip 24. In this manner, the securing members will be received inside a strip 24 and frictionally engage the legs 30 and 32 on the inside surfaces 66 and 68, respectively, and be maintained in their proper selected positions during attachment of the track assembly to the rear wall 12. The longitudinal length of the securing members 58 and 60 is the same as the distance between the inside surfaces 66 and 68 of the legs 30 and 32. In this manner, regardless of the orientation of the shim 38, the securing members 58 and 60 will be received within the strip.

During the assembly of the refrigerator, when the rigid strips 24 are being attached to the rear wall 12, some areas of the rear wall will be bowed, that is, an area will depart from the plane of the rest of the rear wall. This is particularly true of rear walls that are made of relatively thin material. The bowed area is usually in the direction of the insulation which is away from the interior of the cabinet and usually near the top of strip 24 and, particularly, the center strip. If the bowed area is not too great relative to the plane of the rest of the liner, such as shown in FIG. 3 and designated as depth A-A, then the shim 38 is oriented as shown in FIG. 3. That is, the stepped sides 46 and 48 are received by the terminal ends 70 and 72 of the legs 30 and 32, respectively, of the strip 24. This is the reason that the steps are spaced apart a distance equal to the distance between the legs 30 and 32. In the position shown in FIG. 3, the securing members 58 and 60 are received in the strip 24 and the bowed areas 62 and 64 frictionally engage the surfaces 66 and 68 of legs 30 and 32. If the bowed area is more substantial, such as the depth designated B-B in FIG. 4, then the shim 38 is rotated 90° to that shown in FIG. 3 and in this position, the unstepped sides 54 and 56 of the shim 38 abut the terminal ends 70 and 72 of the legs 30 and 32 of strip 24. This shim 38 orientation allows the full thickness of the base 40 to be between the rear wall 12 and the terminals ends 70 and 72 of the strip 24. Also, in this position, it will be noted that the securing members 58 and 60 are again received within the strip between the legs 30 and 32.

The shim 38 may be made of any suitable material that is of sufficient strength under the conditions it is anticipated to be used. I have found plastic material which has been extruded and trimmed to the proper length to be satisfactory is most situations regarding track assemblies for refrigerators. The shim could, of course, also be injection molded. By using plastic, it will be noted that all of the shim, including the securing members 58 and 60, may be integrally molded, thus making them relatively low in cost. It will be understood that if the distance between the terminal ends 70 and 72 of the legs 30 and 32 varies from strip to strip, the dimensions of the shim will also vary to accommodate each respective strip. For instance, the shims 38 for the center strip 24 will have larger dimensions since that strip is wider than the strips 24 at each side of the rear wall.

With the strips 24 secured to the rear wall 12 and the shims 38 appropriately placed in the bowed areas of the rear wall, the strip or plurality of strips is in vertical alignment and when the support means, such as shelf brackets 26, are attached to the strips 24, they are in alignment to afford good positioning of the shelves. Of particular value is the strip 24 located in the central portion of the rear wall 12 when it is necessary for the two side-by-side shelves 18 and 20 to be in close parallel alignment relative to their side edge portions 22. Without the track assembly of this invention and with the rear wall 12 bowed, the side edge portions 22 of the shelves 18 and 20 would interfere with each other and in many cases if the bowing was great enough, such as shown in FIG. 4 as depth B-B, they could not be placed side by side.

For placing shelves vertically on the spaced strips 24, there is provided a plurality of brackets 26 which are movable up and down on the strips 24. These brackets 26 may be separate or joined with the shelves as an integral unit. The brackets 26 are cantilevered and include a shelf-supporting arm 74 which has at one end thereof a strip securing portion 76. The strip securing portion 76 includes an upper hook-shaped attachment means or element 78 which is removably inserted in the slots 36 of the strips 24. For this purpose, the hook-shaped element 78 is dimensioned to be slightly smaller than the slots 36 so that it may be received therethrough. Also, on the strip securing portion 76 of the brackets 26 and located below the hook-shaped element 78 is a tab 80 dimensioned to be slightly smaller than the slots 36 and, therefore, it will be received in the slots 36. The tab 80 is utilized to stabilize the bracket 26 when it is engaged in the strip 24. With this tab 80 lateral movement of the strip securing portion 76 of the brackets 26 is limited and also unintentional upward movement of this strip securing portion 76 is prevented. By this arrangement then to remove the bracket 26 from the strip 24, the bracket arm 74 must be rotated upwardly to pivot about hook-shaped portion 78 and, thus, disengage the tab 80 from the slots 36 and then remove the hook-shaped element 78 from engagement with the slots 36.

The foregoing is a description of the preferred embodiment of the invention. In accordance with the Patent Statutes, changes may be made in the disclosed track assembly without actually departing from the true spirit and scope of the invention as defined in the appended claims.

What is claimed is:

1. A track assembly for securing to a wall and receiving shelves:

a. an elongated strip, said strip being U-shaped in lateral cross section to provide two-spaced parallel legs and a connecting portion, b. a shim having a base with a top and bottom surface, the bottom surface contacts the wall, and each of two parallel sides of the shim having a step, said steps being spaced apart a distance equal to the distance of the spaced parallel legs of the strip and the other two parallel sides of the shim being unstepped and spaced apart from each other a distance greater than the distance of the spaced parallel legs of the strips, and c. support means attached to the strip for supporting shelves thereon.

2. The track assembly of claim 1 wherein the strip has a plurality of slots along its length and the support means is a bracket having hook-shaped attachment means at one end removably inserted in the slots for support of the bracket.

3. The track assembly of claim 1 wherein the top surface of the shim carries means for securing the shim to the strip.

4. The track assembly of claim 1 wherein the steps are inwardly relative to the bottom surface of the base.

5. The track assembly of claim 1 wherein there are two spaced parallel, elongated strips.

6. A track assembly for securing to a wall and receiving shelves:

a. three-spaced parallel, elongated strips, the middle strip being U-shaped in lateral cross section to provide two-spaced parallel legs and a connecting portion, b. a shim having a base with a top and bottom surface, the bottom surface contacts the wall, and each of two parallel sides of the shim having a step, said steps being spaced apart a distance equal to the distance of the spaced parallel legs of the middle strip and the other two parallel sides of the shim being unstepped and spaced apart from each other a distance greater than the distance of the spaced parallel legs of the middle strip, and c. support means attached to the strips for supporting shelves thereon.

7. The track assembly of claim 6 wherein the middle strip has a plurality of slots along its length and the support means are brackets having hook-shaped attachment means at one end removably inserted in the slots for support of the bracket.

8. The track assembly of claim 6 wherein the strips each have a plurality of slots along their lengths and the support means are brackets having hook-shaped attachment means at one end removably inserted in the slots for support of the bracket.

9. The track assembly of claim 6 wherein the top surface of the shim carries means for securing the shim to a strip.

10. The track assembly of claim 6 wherein the steps are inwardly relative to the bottom surface of the base.

11. In a cabinet comprising side and rear walls defining a compartment having an opening at the front thereof, a track assembly for securing to the rear wall and receiving shelves comprising:

a. three-spaced parallel, elongated strips having a plurality of slots along their lengths, one strip being located in the central portion of the rear wall, each strip being U-shaped in lateral cross section to provide two-spaced parallel legs and a connecting portion, b. support means attached to the strips for supporting shelves thereon, and c. a shim having a base with a top and bottom surface, the bottom surface contacts the rear wall, and the top surface carries means for securing the shim to a strip, each of two parallel sides of said shim having a step, said steps being spaced apart from each other a distance equal to the distance of the spaced parallel legs of the strip, the other two parallel sides of the shim being unstepped and spaced apart from each other a distance greater than the distance of the spaced parallel legs of the centrally located strip.

12. In the cabinet of claim 11 wherein the steps of the shim are inwardly relative to the bottom surface of the base.

13. In the cabinet of claim 11 wherein the strips each have a plurality of slots along their lengths and the support means are brackets having hook-shaped attachment means at one end removably inserted in the slots for support of the bracket.

14. In the cabinet of claim 11 wherein there are two shelves positioned on the support means in the same plane and each includes parallel side edge portions, said side edge portions of one shelf being maintained parallel to the side edge portions of the other shelf by the use of said shim in cooperation with the middle strip.

* * * * *